US007171883B2

(12) United States Patent
Ishii et al.

(10) Patent No.: US 7,171,883 B2
(45) Date of Patent: Feb. 6, 2007

(54) PUNCHING APPARATUS AND THE PUNCHING UNIT THEREOF

(75) Inventors: Toru Ishii, Hamamatsu (JP); Shinobu Kawase, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 74 days.

(21) Appl. No.: 09/760,593

(22) Filed: Jan. 16, 2001

(65) Prior Publication Data

US 2001/0008099 A1 Jul. 19, 2001

(30) Foreign Application Priority Data

Jan. 18, 2000 (JP) ..... 2000-009555

(51) Int. Cl.
*B26D 7/00* (2006.01)

(52) U.S. Cl. ..... 83/559; 83/685; 29/465

(58) Field of Classification Search ..... 83/160, 83/162, 684, 533, 405, 40, 669, 559, 571, 83/685; 100/214, 219, 257, 258 R, 258 A; 29/465

See application file for complete search history.

(56) References Cited

U.S. PATENT DOCUMENTS 1,801,490 A * 4/1931 Falstrom ..... 83/698.71
3,568,555 A * 3/1971 Stroh ..... 83/146
3,848,494 A * 11/1974 Gargrave et al. ..... 83/109
3,880,038 A * 4/1975 Mangos ..... 83/685
4,085,639 A * 4/1978 Marconi ..... 83/157
4,552,050 A * 11/1985 Grefe ..... 83/685
4,555,840 A * 12/1985 Nakamura ..... 29/465
4,555,968 A * 12/1985 Raney et al. ..... 83/209
4,945,954 A * 8/1990 Wehrly et al. ..... 140/105
5,350,347 A * 9/1994 Fujiwara et al. ..... 483/29
5,730,039 A * 3/1998 Holliday et al. ..... 83/699.41

FOREIGN PATENT DOCUMENTS

| | | |
|---|---|---|
| JP | 03-277411 | 9/1991 |
| JP | 03-239498 | 10/1991 |
| JP | 08-071990 | 3/1996 |
| JP | 10-217198 | 8/1998 |
| JP | 2000-326296 | 11/2000 |

OTHER PUBLICATIONS

Notice of Reasons for Rejection dated Apr. 22, 2003 (and English translation of same).

* cited by examiner

*Primary Examiner*—Kenneth E. Peterson
*Assistant Examiner*—Phong Nguyen
(74) *Attorney, Agent, or Firm*—Dickstein Shapiro LLP

(57) ABSTRACT

A punching apparatus is provided which can of punch a non-circular holes at a predetermined position of a work piece. In the punching apparatus for punching a hole by means of a punch integrated into any one of the moving part of a press working machine or the supporting part of the press working machine, and a die integrated with the other one of the moving part and the supporting part; each of the punch and the die has plurality of planes to be fitted with datum planes of a fitting jig. The punching unit for the punching apparatus comprises a punch, a die, and a fitting jig for positioning the punch and the die with respect to each other, wherein each of the punch and the die has plurality of faces for fitting and the fitting jig has datum planes to be fitted with the planes for fitting of the punch and the die.

2 Claims, 12 Drawing Sheets

PUNCHING APPARATUS AND THE PUNCHING UNIT THEREOF

BACKGROUND OF THE INVENTION

1. Field of the Invention

The present invention relates to a punching apparatus which punches a hole at a predetermined location in a work piece by a punch constructed in a moving part (in general a ram) of a press working machine and a die constructed in a supporting part (in general a bed) of the press working machine. The present application also relates to a punching unit which is suited to the above punching apparatus.

2. Background Art

FIGS. 12 to 15 show a punching apparatus disclosed in the Japanese Patent Publication No. 2000-326296. In the punching apparatus shown in FIGS. 12 to 15, a punch unit 26 which comprises a punch 26*g* mounted on a punch holder (a moving part of the punching apparatus) 24 which is integrated into a non-rotatable rod 22 by bolts 23 and is fixed so as to be capable of rotating capably in rounding around the axis L along a direction of the punching operation within a predetermined angle (the angle described by the arc of the circular slot 24*a* in FIG. 13), also, the punching apparatus die unit 27 which comprises a die 27*h* is mounted on a die bed (a supporting part of the punching apparatus) 25 and is fixed so as to be capable of rotating around the axis L along the direction for the punching operation.

As shown in FIGS. 12 to 14, the punch unit 26 comprises an approximately circular base plate 26*b* integrated with a punch holder 24 integrated with a non-rotatable rod 22, by means of six fastening bolts 26*a* inserted and screwed through the slot hole 24*a* of the non-rotatable punch holder 24; a rectangular support plate 26*d* integrated with the base plate 26*b* by means of four fastening bolts 26*c*; a punch 26*g* having a rectangular cross-section integrated with a support plate 26*d* by means of two screws 26*e* and two washers 26*f*; and a work presser foot 26*k*, integrated so as to be movable vertically (movable upward for a predetermined length from the position shown in FIG. 12) by means of four sets of a guide pin 26*i* and a bushing 26*j*. The upper end of the each guide pin 26*i* is fixed to the base plate 26*b*, and the lower end of the each guide pin 26*i* slidably supports the work presser foot 26*k* in the vertical direction. The each bush 26*j* is attached to the work presser foot 26*k* and each bush 26*j* helps smooth the sliding of the guide pin 26*i*. Each spring unit 26*h* comprises a pin 26*j* integrated with the work presser foot 26*k* engages with the base plate 26*b* so as to be detachable in the upward direction and a compression coil Spring 26*h*2 disposed around the pin 26*h*1 and compressed between the base plate 26*b* and the work presser foot 26*k*. Here, the spring unit, the bush 26*j*, and the work presser foot 26*k* are shown only in FIG. 12.

As shown in FIGS. 12 and 15, the die unit 27 comprises a base plate 27*b* integrated with the die holder 25 by means of four unit presser foots 27*a*; a rectangular support plate 27*e* integrated with the base plate 27*b* by means of four fixing bolts and two pins 27*d*; a die 27*h*, having a rectangular hole 27*h*1 into which the punch 26*g* can be inserted to a predetermined depth, integrated with the base plate 27*b* by means of two screws 27*f* and washers 27*g*; a circular die cover 27*j* integrated with the support plate 27*e* by means of two fixing bolts 27*i*. Each units presser foot 27*a* comprises a block 27*a*1 having a claw portion at the upper part for engaging with the support plate 27*e*, and a pin 27*a*2 and a pair of fixation bolts 27*a*3 for fixing the block 27*a*1 at a home position.

As shown in FIGS. 12 and 15, the base plate 26*b* of the punch unit 26 and the base plate 27*b* of the die unit 27 are mutually connected by using four connecting pins 28 and a pair of upper and lower bushings 29 (fixed at each base plate) such that the punch 26*g* and the die 27*h* can integrally rotate by the same rotational phase (in the state where the punch 26*g* can accurately inter-fit the hole 27*h*1 of the die 27*h*). Each connecting pin 28 is fitted with each bush 29 so as to be able to be inserted into or drawn out from each other, so that the punch unit 26 and the die unit 27 can be independently replaced with other units.

In the above punching apparatus shown in FIGS. 12 to 15, it is necessary to connect and relatively position the punch 26*h* to the die 27*h* by operating the four connecting pins 28 and eight bushings 29. Furthermore, the bushing 29, the base plate 26*b*, the guide pin 26*i* and supporting plate 26*d* must be arranged between the punch 26*g* and each connecting pin 28, and the bushing 29, the base plate 27*b*, the pin 27*d* and the supporting plate 27*e* must be arranged between the die 27*h* and each connecting pin 28.

Because it is necessary to operate so many parts (the four connecting pins 28 and the eight bushings 29) in order to relatively position the punch 26*g* and the die 27*h*, the costs and man-hours required to constructing the punch 26*g* and the die 27*h* are increased. Because there are such many parts (the support plate 26*d*, the guide pin 26*i*, the base plate 26*b*, the bushing 29 for punch 26*g*, the connecting pins 28, the bushing 29 for the die 27, the base plate 27*b*, the pin 27*d*, the supporting plate 27*e* and etc) between the punch 26*g* and the die 27*h*, the dimensional errors of each parts accumulate. Because the bushing 29 located on the upper end of the connecting pin 28 supports the punch 26*g* and the bushing 29 located on the lower end of the connecting pin 28 supports the die 27*h*, the space between the punch 26*g* and the die 27*h* becomes to be too much to exactly position the punch 26*g* relative to the die 27*h*.

SUMMARY OF THE INVENTION

The present invention was made in the view of the above-mentioned problems.

According to one aspect of the present invention, in a punching apparatus for punching a hole at a predetermined location on a work piece by means of a punch integrated into anyone of a moving part of a press working machine and a supporting part of the press working machine and a die integrated with another one of the moving part and the supporting part, each of the punch and the die has a plurality of planes for fitting, fitted with datum planes of a fitting jig.

In the above punching apparatus, it is possible for the punch and the die to be positioned with respect to each other by fitting each of the planes for fitting of the punch and the die with the datum planes of the fitting jig. The present invention is preferably for a punching apparatus which punches a noncircular hole such as a rectangular hole.

It is possible to mutually position the punch and the die using the fitting jig which is the only inclusion between the punch and the die. Therefore the punch is integrated into a moving part of a press working machine with a high accuracy and the die is also integrated into a supporting part of the press working machine with high accuracy, and it is possible to punch a hole into a work piece with high accuracy after removing the fitting jig from the punch and the die.

The positioning for the punch and the die with respect to each other is completed by fitting the plane for fitting of the punch with the datum plane of the fitting jig and fitting the each plane for fitting of the die with the datum plane of the fitting jig, thus it is possible to minimize the parts for the fitting operation, reduce the product cost, and also expedite construction by reducing the steps for a fitting.

The punch and the die are capable of rotating, independently of the moving part and the supporting part, around an axis which lies parallel to a direction for the punching, and cannot rotate relative to each other by touching the planes for fitting with the datum planes of the fitting jig, therefore it is possible to position the punch and the die at a desirable rotating position.

When the planes for fitting are along the direction for punching and cross each other in a right angle, it is possible to simplify the construction of the fitting jig by aligning the planes for fitting of the punch and the die in a single plane and fitting the planes for fitting with the same datum planes of the fitting jig, thereby reducing the cost for manufacturing the fitting jig.

According to another aspect of the present invention, in a punching unit for a punching apparatus, each of a punch and a die has plurality of planes for fitting and a fitting jig has datum planes fitted with the planes for fitting of the punch and the die. Therefore the punch and the die can be mutually positioned by fitting the each planes for fitting of the punch and the die with the datum planes of the fitting jig.

If the punch and the die can rotate independent of the punching machine around an axis along the direction for punching and can also be rotated together in a state where the datum planes of the fitting jig are attached with each of the planes for fitting of the punch and the die, it is possible for positioning the punch and the die at a desirable position through the direction for rotating.

It is preferable for the fitting jig to have a U-shaped cross section having a pair of arms on one inner surface of which one of the datum planes is arranged and on the other one inner surface of which the other one of the datum planes is arranged in order to hold the punch and die between the pair of arms and also order to fit the planes for fitting of the punch and the die with the datum planes of the fitting jig while rotating about the axis.

DETAILED DESCRIPTION OF THE INVENTION

Hereinafter, one embodiment of the present invention is described. The punching apparatus shown in FIGS. 1 to 11 is suitable for punching a wide variety of sheet-shaped work pieces. The punching apparatus comprises a work supporting portion A0 (not shown in FIG. 1) for supporting a work piece (not shown in the figures), a punching portion 10, and an image pickup portion B0.

The work supporting portion A0 is used for supporting the work at a predetermined position by clamping and is mounted on a θ direction transfer mechanism A2, which is mounted on the upper movable carriage A1, so as to be able to fixed around a pivot p in a horizontal plane. The upper movable carriage A1 is mounted on a machine base A6 through an X-axis direction transfer mechanism A3, an intermediate movable carriage A4, and a Y-axis direction transfer mechanism A5 so as to be movable in two directions (the X-axis direction and Y-axis direction) in a horizontal plane.

The θ direction transfer mechanism A2 comprises a supporting axis A2*a* vertically arranged on the work supporting portion A0, and a servo motor which drives the supporting axis A2*a*. The θ direction transfer mechanism is capable of driving or stopping the work supporting portion A0 at an arbitrary angle about the pivot.

The X-axis direction transfer mechanism A3 comprises a pair of guide rails A3*a* mounted on the intermediate movable carriage A4 for supporting the upper movable carriage A1 slidably in the X-axis direction, a screw feed mechanism A3*b* arranged between the both guide rails A3*a* for feeding the upper movable carrier A1 in the X-axis direction, and a servo-motor A3*c* connected with one end of a lead screw of the screw feed mechanism which drives the lead screw, such that the upper movable carrier A1 can be positioned in the X-axis direction by controlling the rotation of the servo-motor A3*c* by a controller (not shown).

The Y-axis direction transfer mechanism A5 comprises a pair of guide rails A5*a* mounted on a machine base A6 for supporting the intermediate movable carrier A4 slidably in the Y-axis direction, a screw feed mechanism A5*b* which is arranged between the two rails A5*a* for transferring the intermediate movable carriage A4 in the Y-axis direction, and a servo-motor A5*c* connected with one end of a lead screw of the screw feed mechanism A5*b* which drives the lead screw, such that the intermediate movable carrier A4 can be positioned in the Y-axis direction by controlling the rotation of the servo-motor A5*c* by the controller (not shown).

Figure 1:
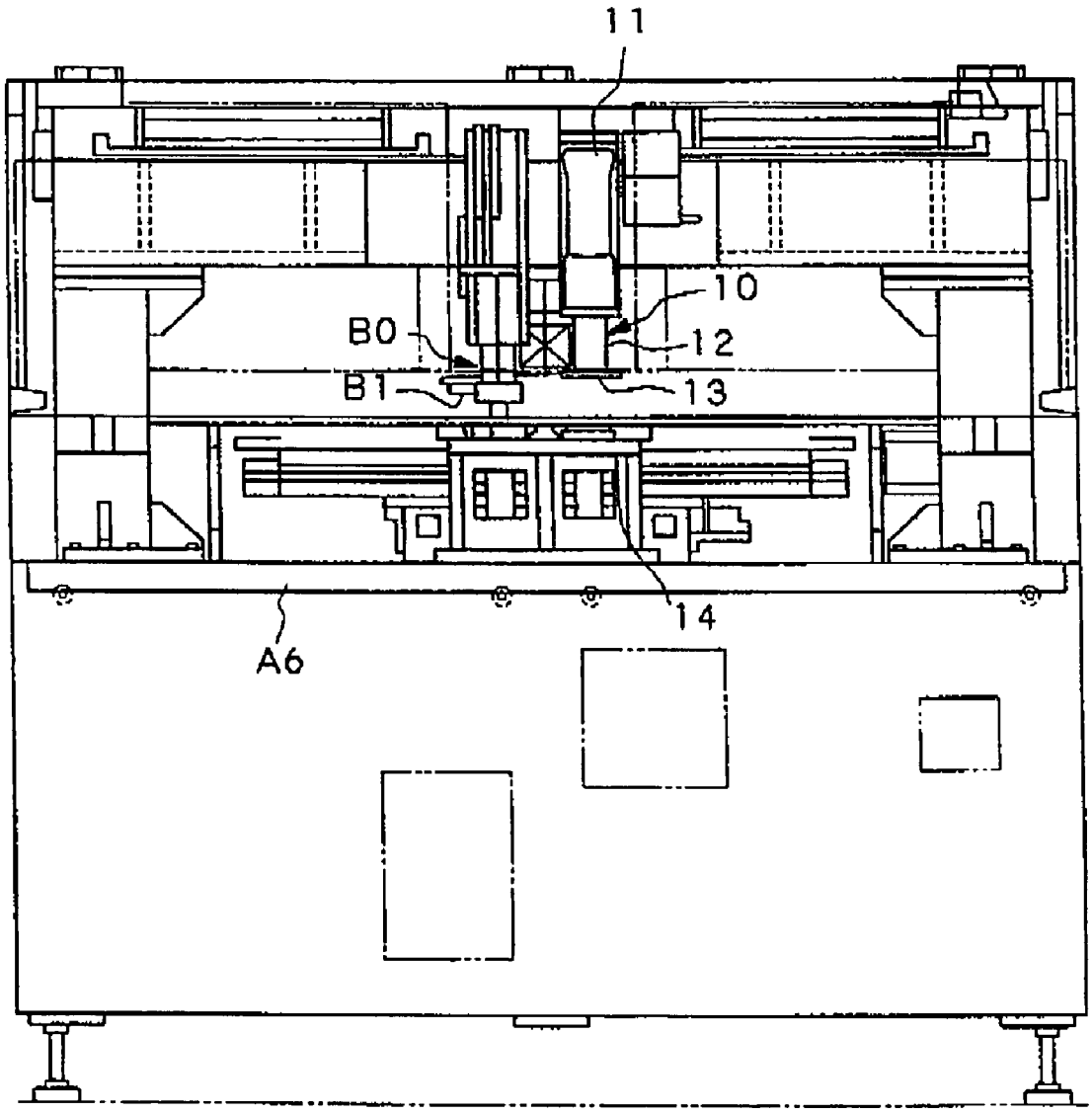
FIG. 1 is a front view of a punching apparatus of a preferred embodiment of the present application.
Figure 2:
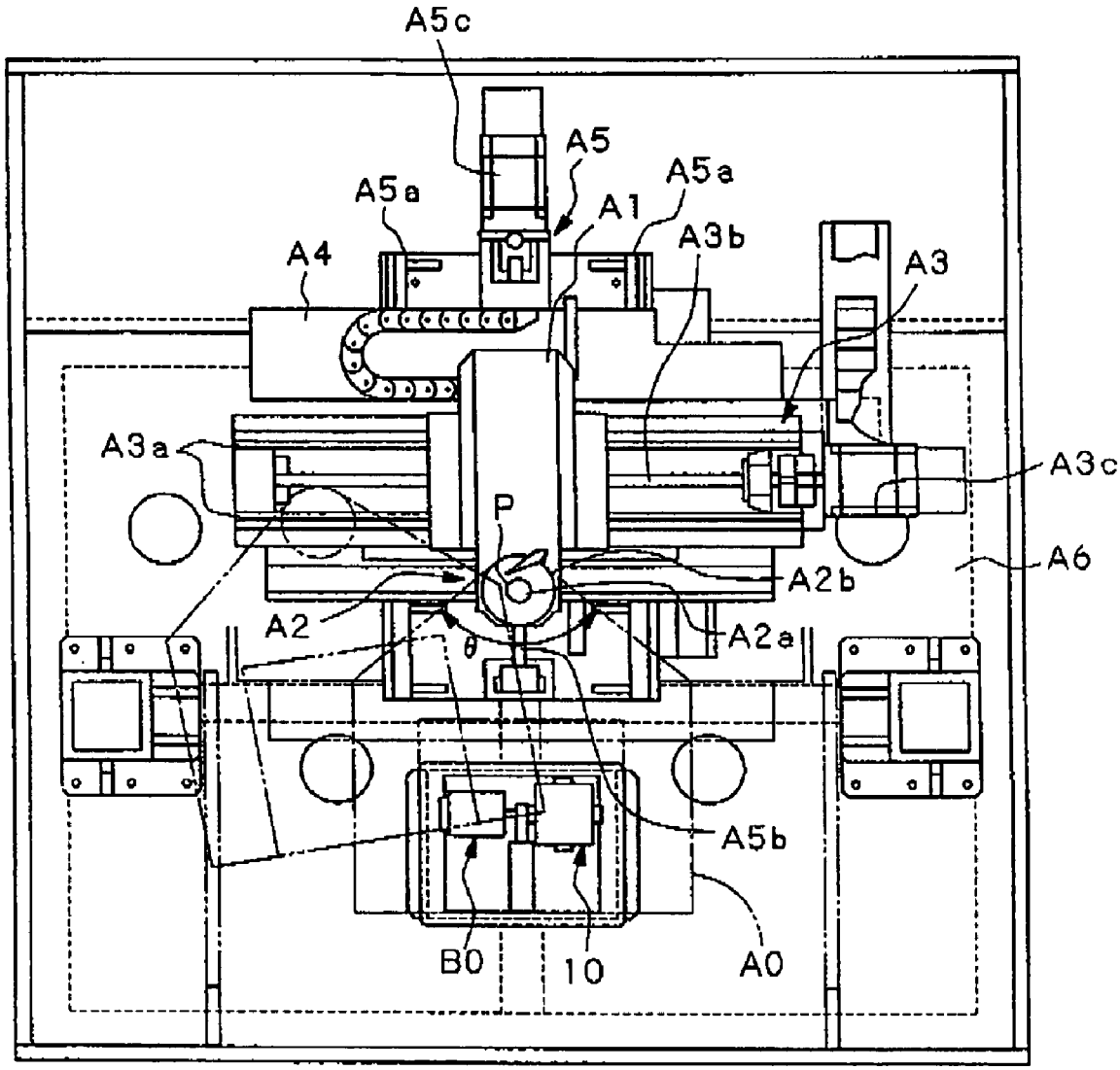
FIG. 2 is a plane view of the punching apparatus which is disclosed in FIG. 1.
Figure 3:
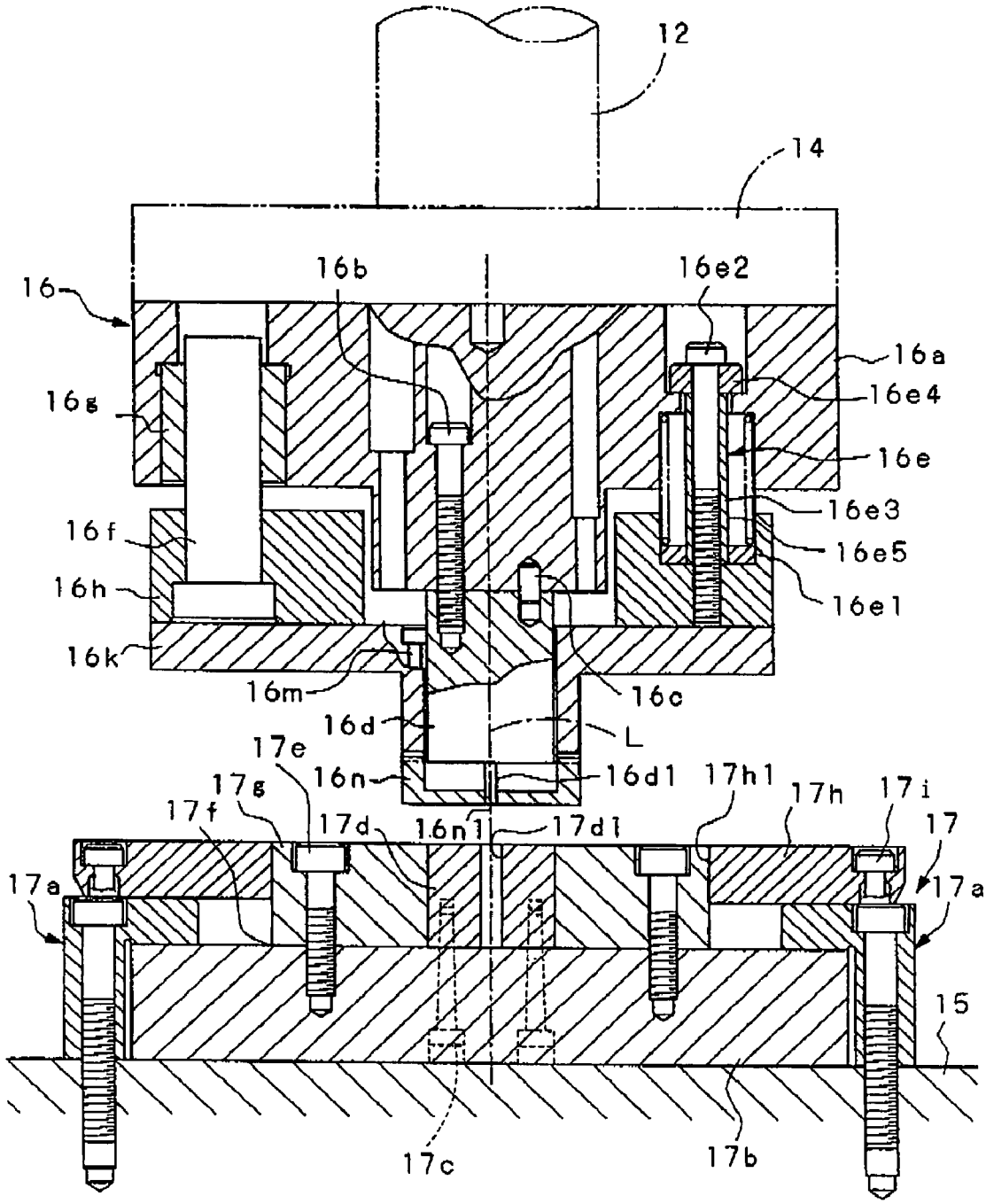
FIG. 3 is a partly cross-sectional front view of the puncher portion of the punching apparatus in which a punch unit and a die unit are integrated.
Figure 4:
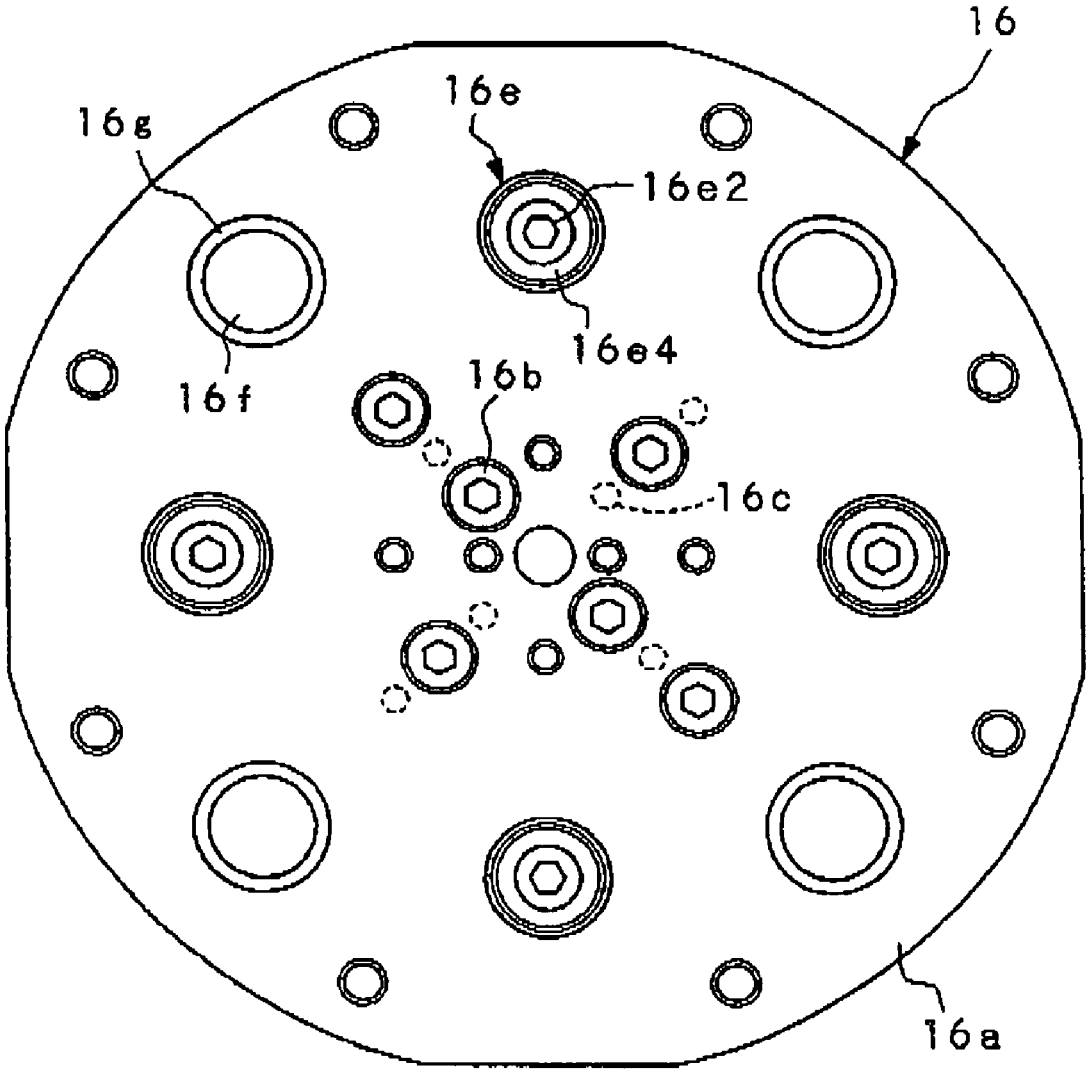
FIG. 4 is a plane view of the punch unit disclosed in FIG. 3.
Figure 5:
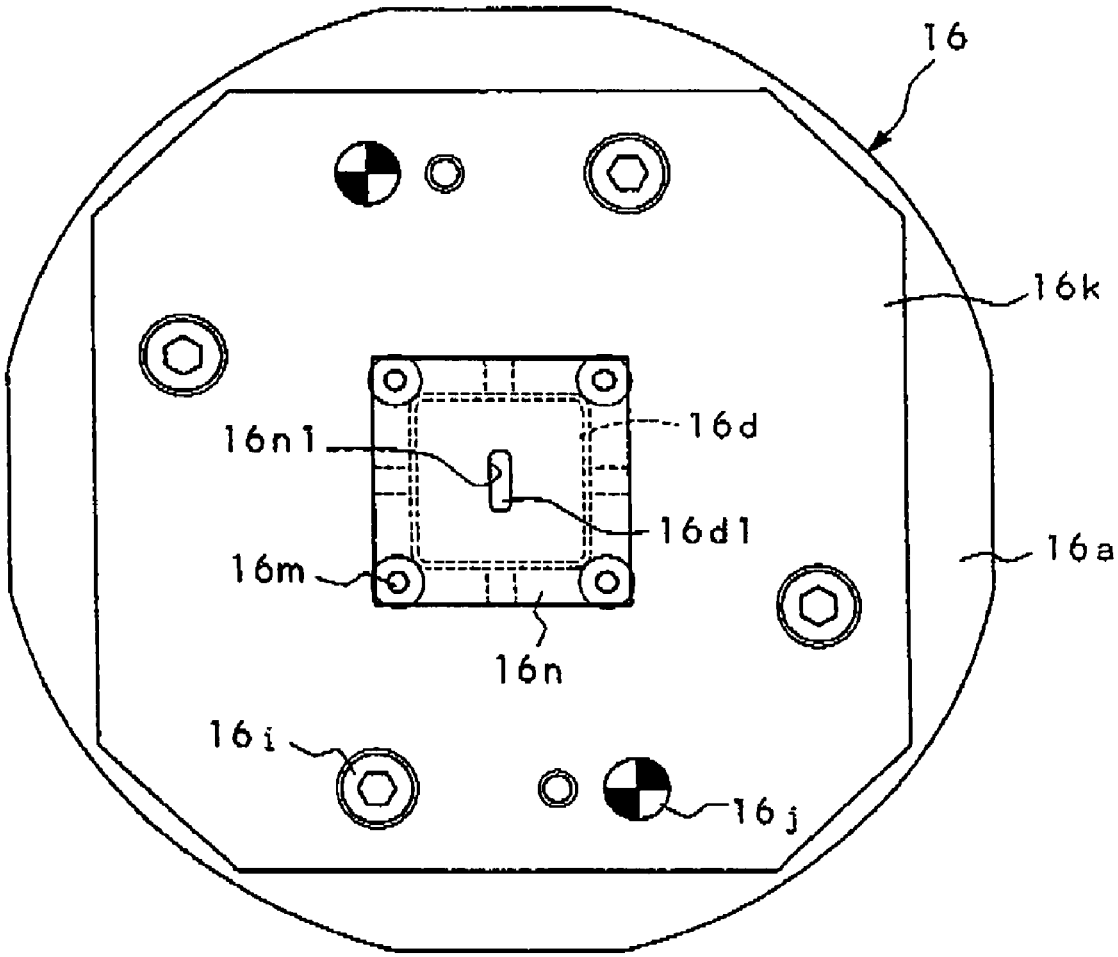
FIG. 5 is a bottom view of the punch unit disclosed in FIG. 3.
Figure 6:
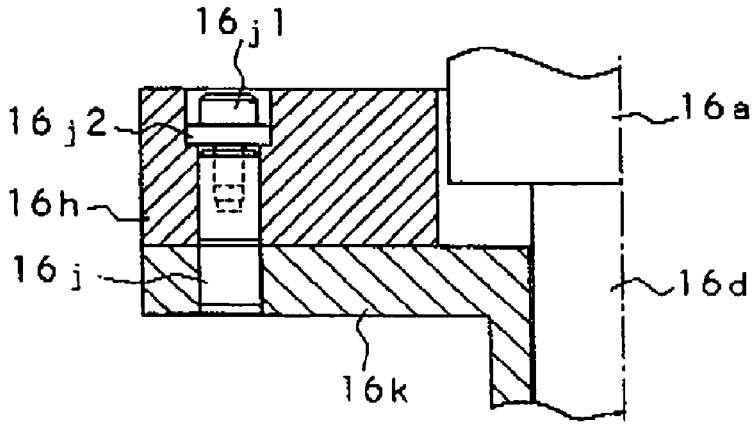
FIG. 6 is a partially cross-sectional view of the punch unit which shows the relationship between a supporting plate for a stripper, a supporting flange for a striper and a positioning pin.

The punching portion 10 is a portion for executing rectangular hole punching for a predetermined portion of a work piece. As shown in FIGS. 1 and 3, the punching portion 10 comprises a punch holder 14 and a die accepting base 15 arranged on the machine base A6 so as to oppose to the punch holder 14. The punch holder 14 is integrated with a bottom end of a rod 12 (not rotatable) using three bolts (not shown) in the same manner as the punch holder 24 of FIGS. 12 to 15 by using the bolts 23. The rod 12 is driven by an elevation device 11 so as to move upward and downward. The puncher holder 14 comprises four slot holes (not shown in the figures) in the form of a circular arc which correspond to the slot holes 24*a* shown in FIGS. 12 and 13. A punch unit 16 is assembled with the punch holder 14 and can rotate about the axis L which lies parallel to the punching direction within a predetermined angular range. A die unit 17 is assembled with the die accepting base 15 and is capable for rotating around the axis L. The punch unit 16 can also be fixed to the punch unit 16 and the die unit 17 can also be fixed to the die accepting base 15.

Figure 12:
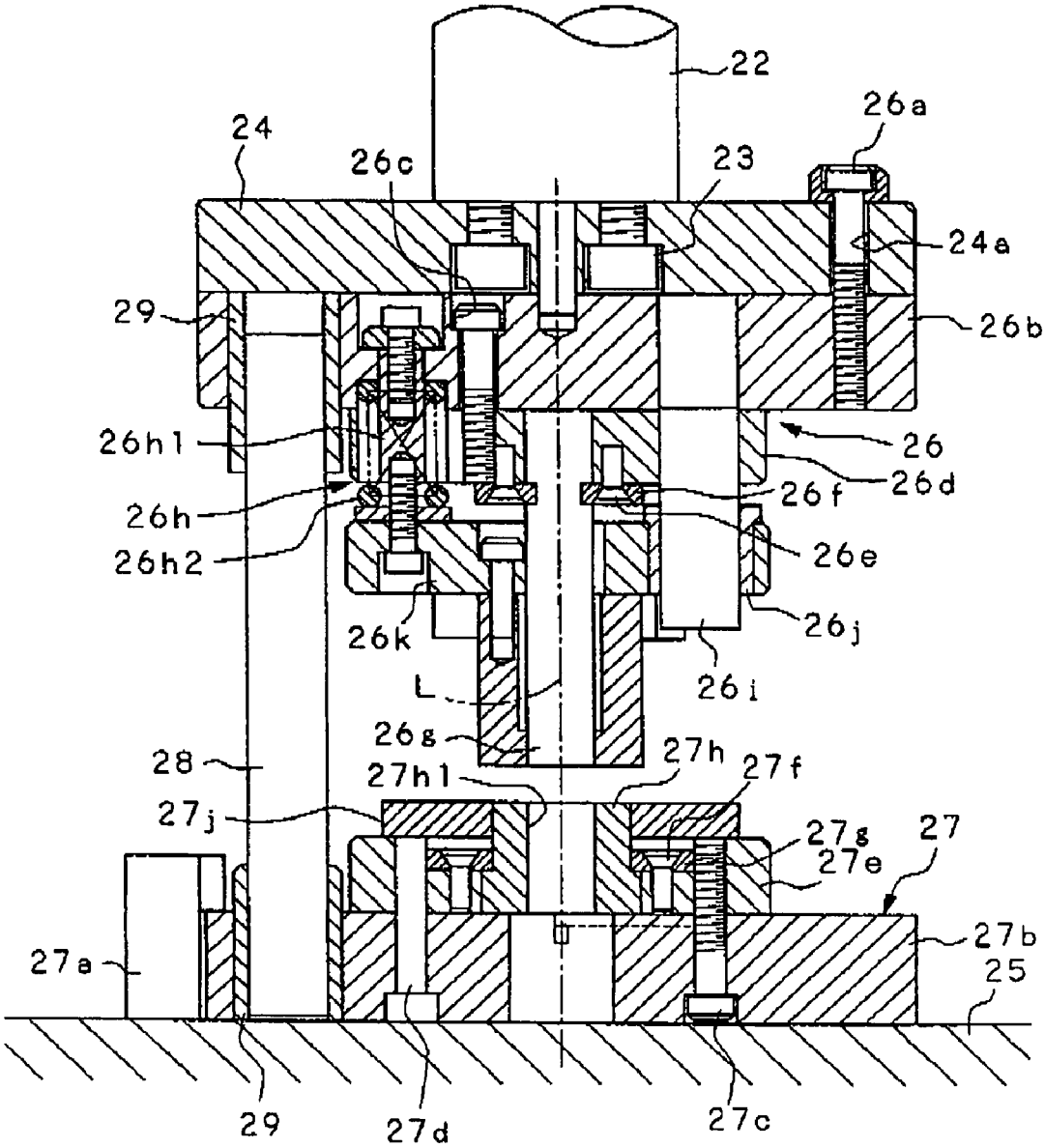
FIG. 12 PRIOR ART
FIG. 12 is a partially cross-sectional view of a punching apparatus of an example of a background art in which a punch unit and a die unit are constructed with a connecting pin.
Figure 13:
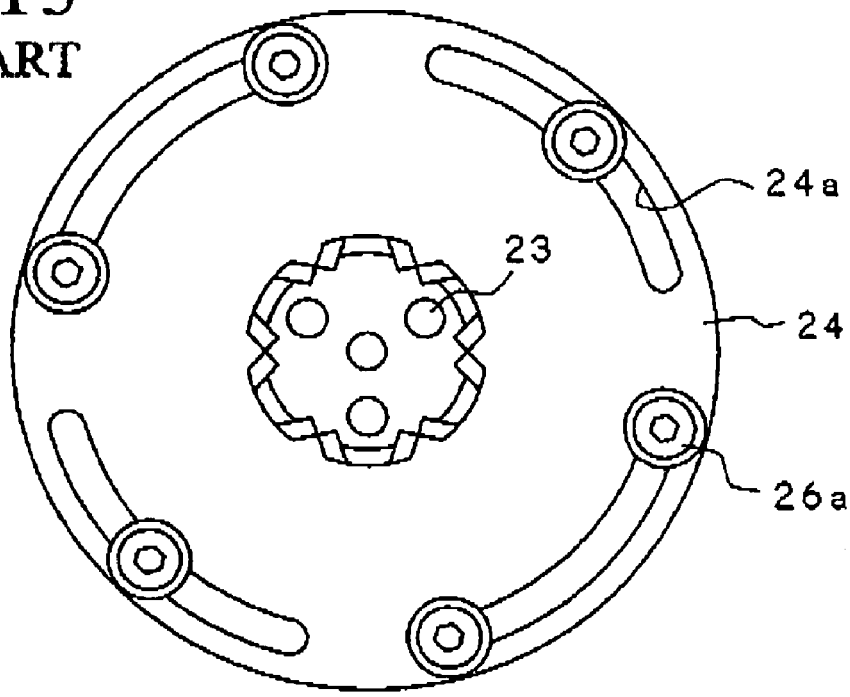
FIG. 13 PRIOR ART
FIG. 13 is a plane view of a punch holder disclosed in FIG. 12.
Figure 14:
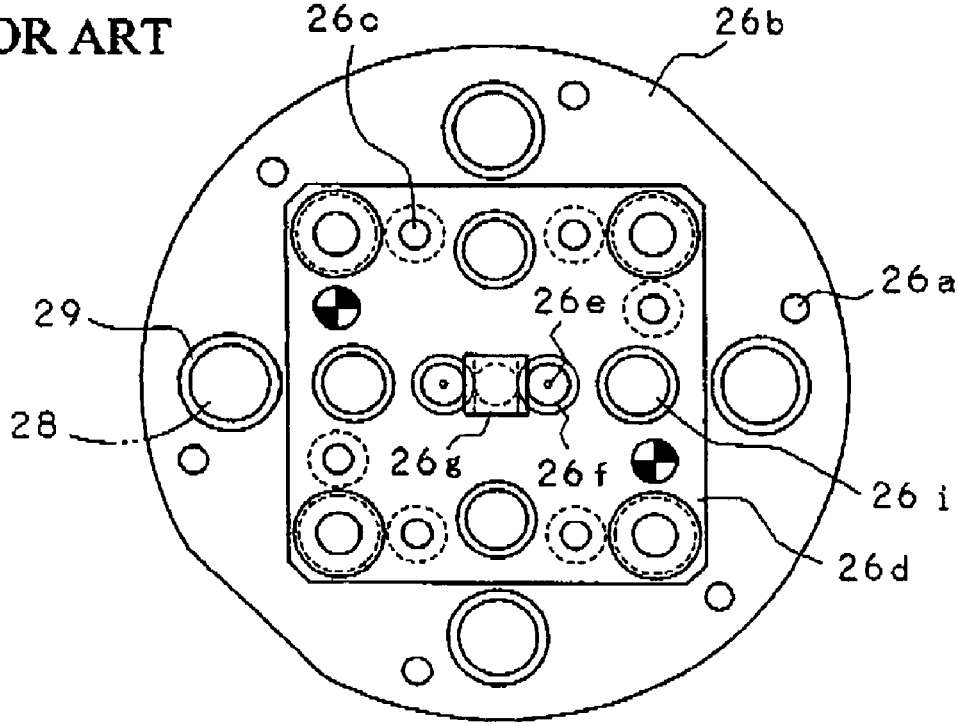
FIG. 14 PRIOR ART
FIG. 14 is a bottom view of the punching unit disclosed in FIG. 12 in which the spring unit, the bush and the supporting plate are removed.
Figure 15:
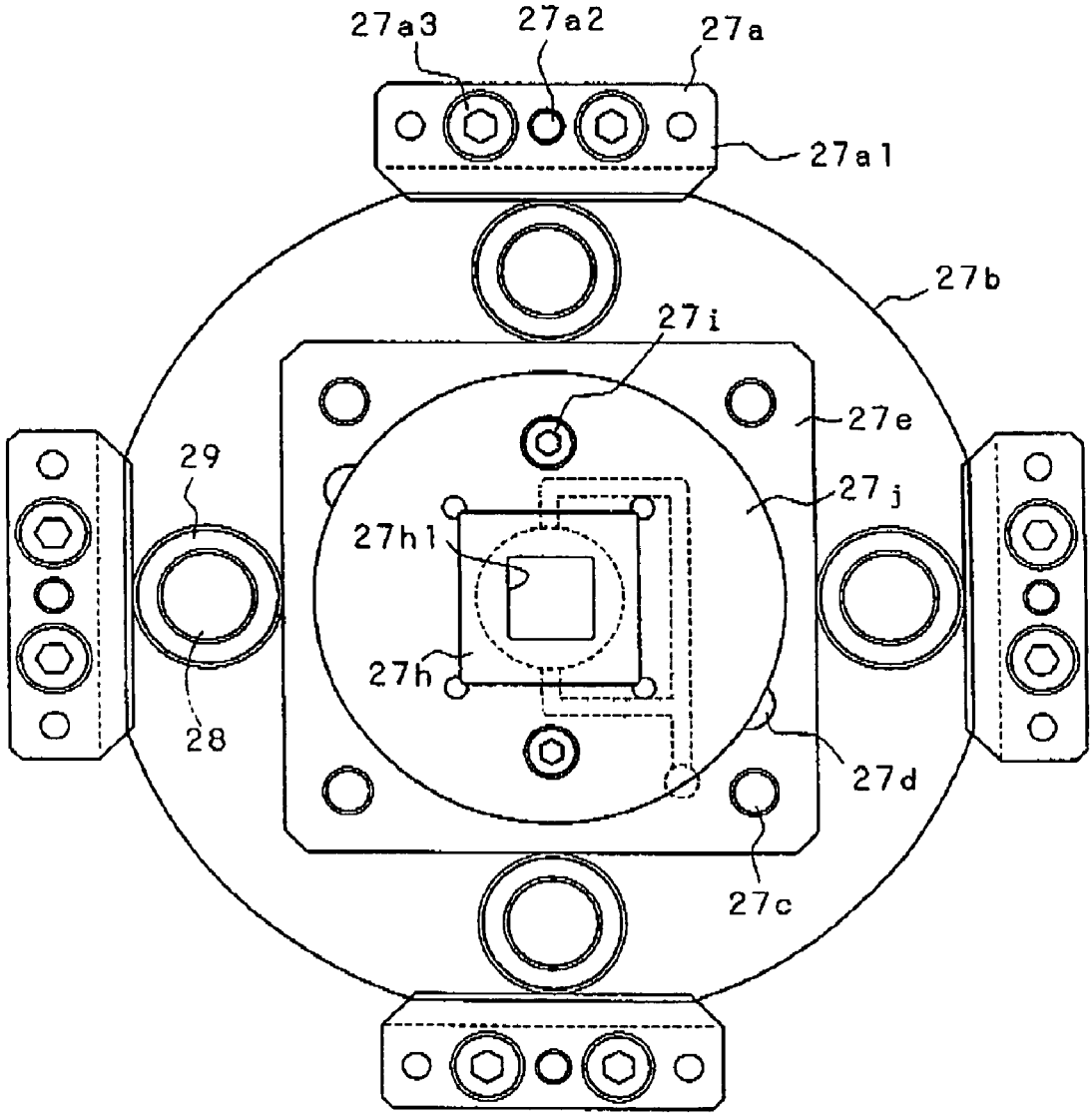
PRIOR ART FIG. 15
FIG. 15 is a plane view of the die unit disclosed in FIG. 12.

The punch unit 16 comprises a circular punch holding flange 16*a* which is integrated with the punch holder 14 by screwing bolts (not shown in figures) which correspond to the bolts 26*a* in FIGS. 12, 13 and 14, through a slot hole (not shown in the figures) in a form of circular arc in the punch holder 14 which is non-rotatably integrated with the non-rotatable rod 12 and punch 16*d* which is integrated with the punch holding flange 16*a* by using two bolts 16*b* and two location pins 16*c*.

The punch unit 16 also comprises a rectangular stripper attaching plate 16*h* which is movably integrated with the punch holding flange 16*a* through the L axis direction in a predetermined length by using four units of spring 16*e*, four guide pins 16*f* and bushes 16*g*, a striper holding flange 16*k* integrated with the stripper attaching plate 16*h* by using four bolts 16*i* (shown in FIG. 5) and two locating pins 16*j* (shown in FIGS. 5 and 6), a stripper 16*n* integrated into the stripper supporting flange 16*k* by using four bolts 16*m*. A through hole 16*n*1 through which the rectangular projection 16*d*1 on a bottom end of the punch 16*d* passes is formed in the stripper 16*n* each small diameter portion of the locating pins 16*j* is tightly fitted to the stripper attaching plate 16*h* and assembled to the stripper attaching plate by using four bolts 16*j*1 and washers 16*j*2.

As shown in FIG. 3, the bottom end of each of the guide pin 16*f* is tightly fitted into the stripper attaching plate 16*h* and an upper end of each guide pin is slidably fitted into the bushing 16*g*. As shown in FIG. 3, each spring unit 16*e* comprises a free washer 16*e*1 assembled in a hollow of the stripper attaching plate 16*h*, a collar 16*e*3 and a fixed washer 16*e*4 assembled into the stripper attaching plate 16*h* by using bolts 16*e*2 and a compressing coil spring 16*e*5 arranged between the free washer 16*e*1 and the punch holding flange 16*a*.

Figure 9:
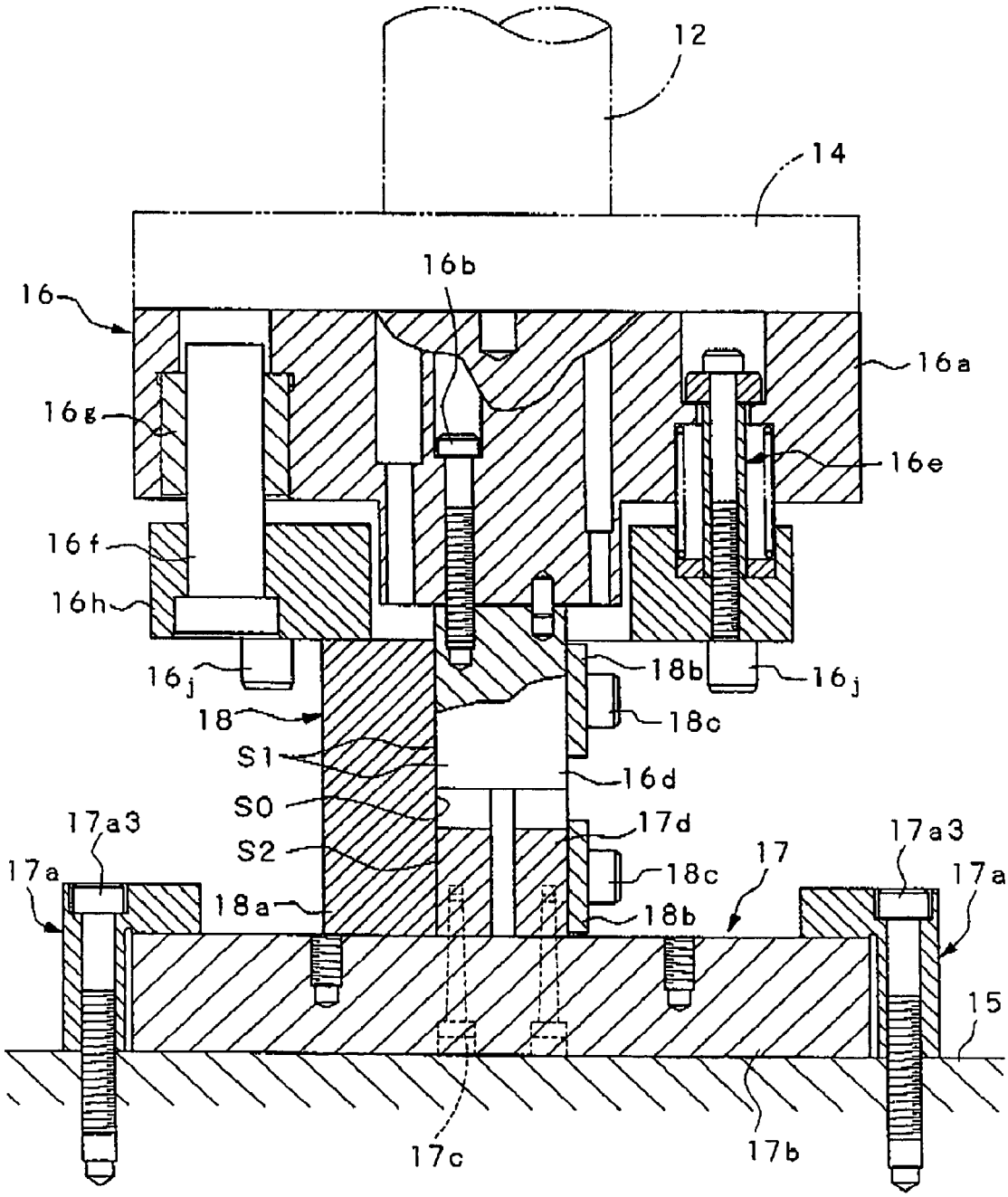
FIG. 9 is a partially cross-sectional view of the punch and the die disclosed in FIG. 3 while relatively positioning the punch with the die by a fitting jig.

As shown in FIGS. 3 and 9, the die unit 17 comprises a base plate 17*b* integrated with the die holder 15 by means of two pressers 17*a*; a die 17*d* integrated with the base plate 17*b* using four bolts 17*c* and having a central rectangular hole 17*d*1 into which the rectangular projection 16*d*1 of the punch 16*d* is inserted to a predetermined length; a circular die surrounding spacer 17*g* integrated with the base plate 17*b*, by using two bolts 17*e* and two plates 17*f*; and having a rectangular hole 17*g*1 which encloses the die 17*d*; a die cover 17*h* integrated with the die holder 15 using four bolts 17*i* and having a circular hole 17*h*1 which encloses the die surrounding spacer 17*g*. Each presser 17*a* comprises a block 17*a*1 having a claw portion which engages with the base plate 17*b* in an upper portion. The each unit presser 17*a* also has a pin 17*a*2 and a pair of bolts 17*a*3 which fix the block 17*a*1 to a predetermined position.

Image pickup portion B0, detects the position of the work piece clamped by the work supporting portion A0 (detects the displaced amounts from the reference location of the work in the X-axis, Y-axis, and the θ directions), and provides a camera B1 for outputting analog image signals to an image processing controller (not shown). The image processing controller obtains the locations of two points marked on the work piece through the image analysis of the image signals, calculates each locational displacement in the respective X, Y and θ directions, and outputs these displacements to a monitor (not shown).

Furthermore, the displacement of the work can be compensated using the θ direction transfer mechanism A2, the X direction transfer mechanism A3 and the Y direction transfer mechanism A5 for restoring the work piece to the home position (to minimize the displacement in each direction). It is to be noted that the compensation of the displacement can be carried out by an automated operation.

The punching apparatus thus constructed according to the present embodiment is capable of providing the steps of compensating the work location, in the state that the punch unit 16 and the die unit 17 are set into the predetermined positions (shown in FIG. 3), into the home position prior to the punching operation by use of the θ direction transfer mechanism A2, the X direction transfer mechanism A3, and the Y direction transfer mechanism A5, and carrying out the punching operation by means of the punch 16*d* and the die 17*d* (when a plurality of holes are to be punched, the punching operations are sequentially carried out). When the punching operation is to be carried out for a predetermined number of work pieces, the above process is repeatedly executed. In this case, if the automated work supply and delivery can be carried out with high accuracy of positioning, the operation to ensure that the work piece is in the home position can be omitted.

Figure 7:
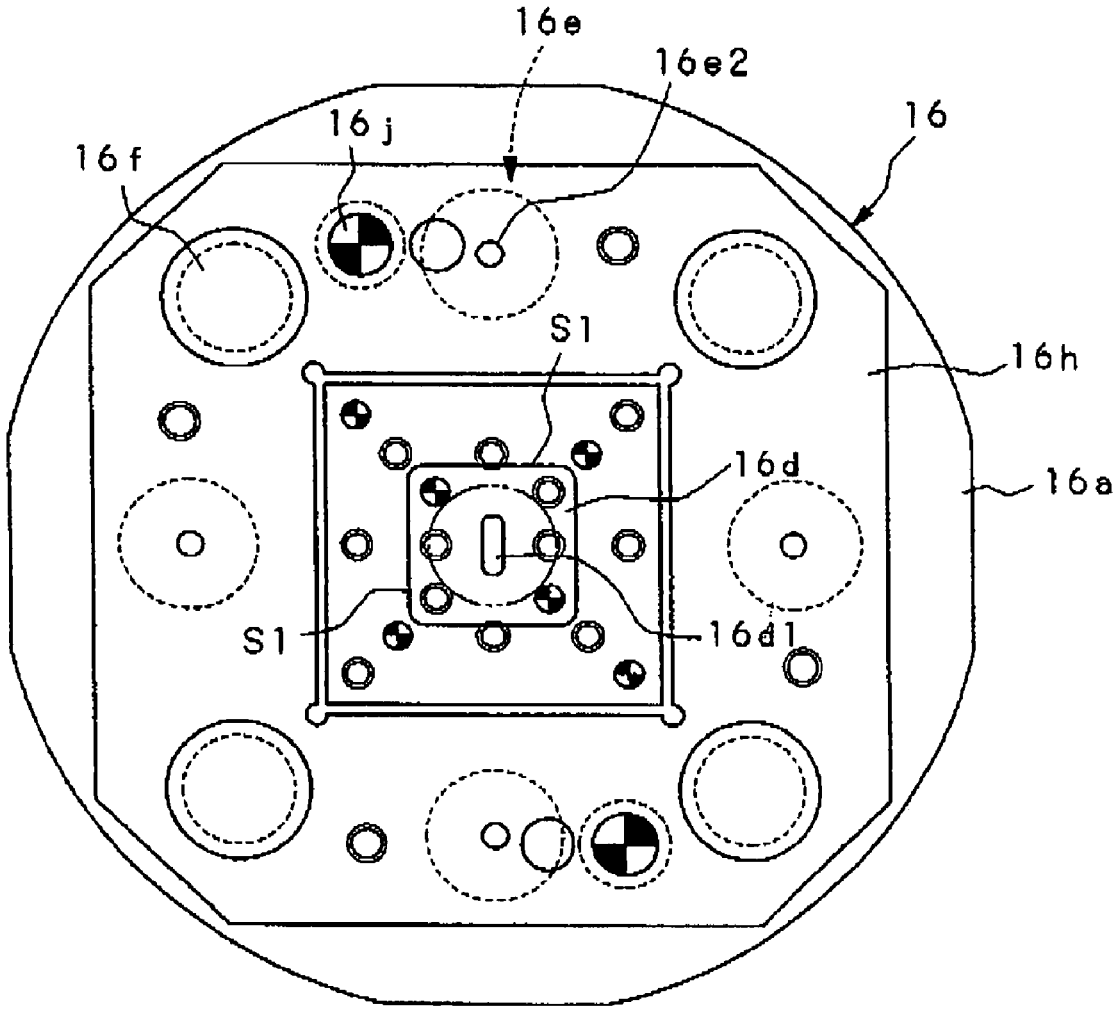
FIG. 7 is a bottom view of the punch unit disclosed in FIG. 3.
Figure 8:
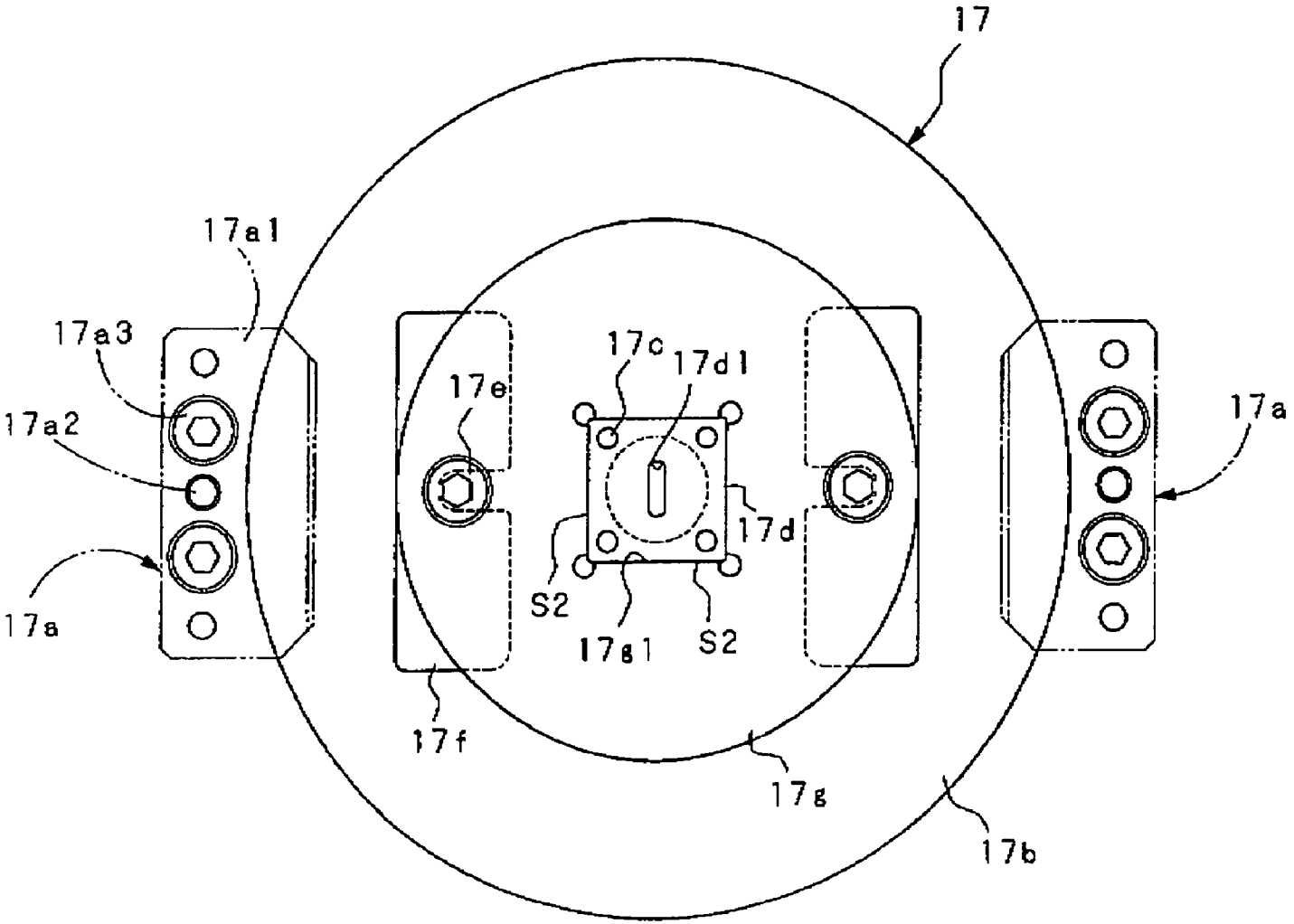
FIG. 8 is a plane view of the die unit disclosed in FIG. 3.
Figure 10:
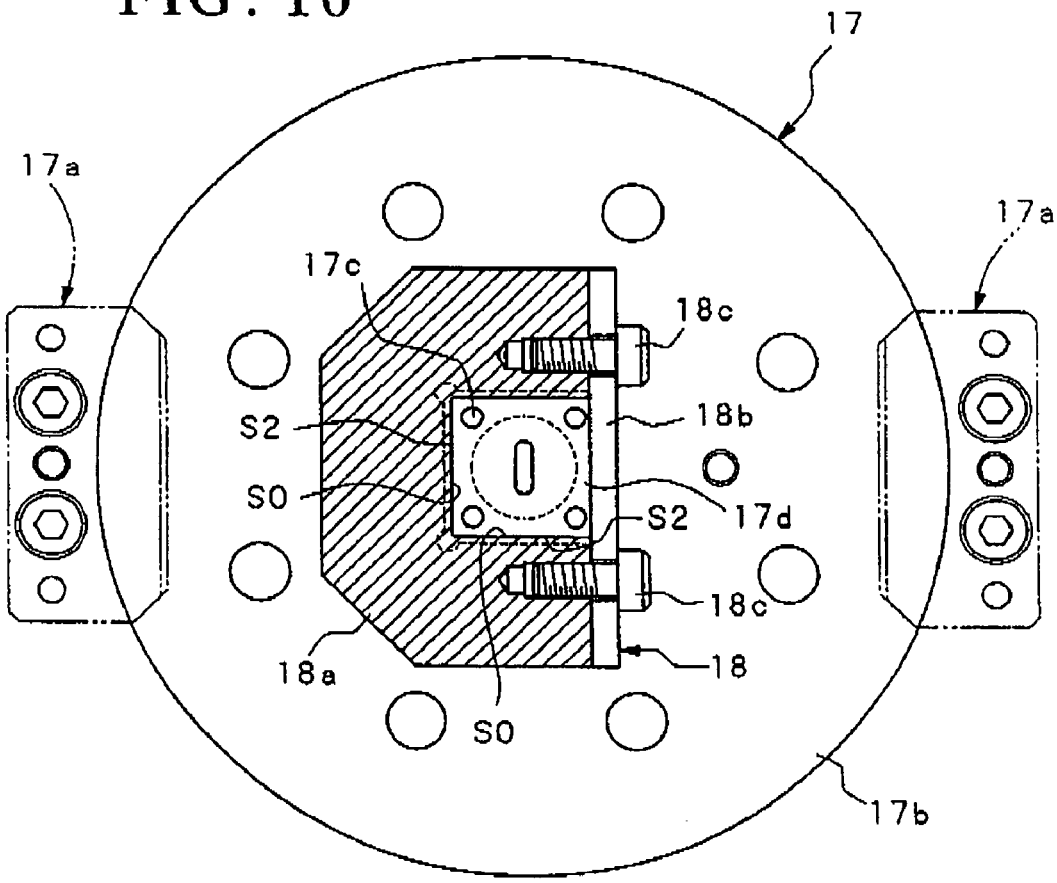
FIG. 10 is a cross-sectional view of the fitting jig and the die unit disclosed in FIG. 9 during the relative positioning.
Figure 11:
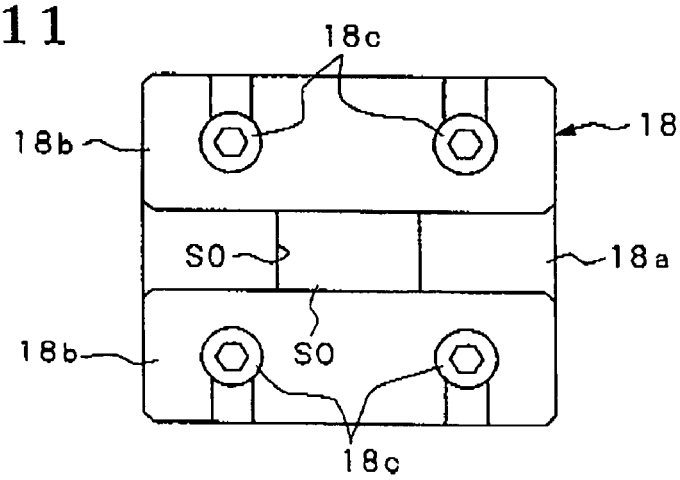
FIG. 11 is a front view of the fitting jig disclosed in FIGS. 9 and 10.

In the embodiment shown in FIGS. 7 and 9, the punch 16*d* comprises two planes for fitting S1 which lie parallel in the direction of the punching operation (vertical direction) and are in right angles to each other, as shown in FIGS. 8, 9 and 10, the die 17*d* comprises two planes for fitting S2 which lie parallel in the direction for punching operation (vertical direction) and are in right angles to each other. Therefore the punch 16*d* and the die 17*d* are positioned with a jig body 18*a* by attaching the planes S1 and S2 with two datum planes S0 of the jig body 18*a*. A fitting jig 18 comprises the jig body 18*a* having a U-shaped cross section and the two datum planes S0, and a pair of E-shaped fixing plates 18*b* each of which is mounted on the jig body 18*a* by two bolts 18*c*. The datum planes S0 are located on an inner surface of the jig body 18*a* and are set to enclose the punch 16*d* and the die 17*d* across an open side of the U shaped cross section, therefore the fixing plates 18*b* are fitted with the jig body 18 thus constructed.

The punch 16*d* can be located and fitted (set at a predetermined position) relative to the die 17*d* by the following steps.

i. Connecting the punch 16*d* with the die 17*d* with the fitting jig 18 in a state where the four bolts 17*a*3 of the die unit 17 are loosened before integrating the striper supporting flange 16*k* and stripper 16*n* of the punch unit 16 with the die surrounding spacer 17*g* and the die cover 17*h* of the die unit 17.

ii. Attaching a plane for fitting S1 of the punch 16*d* and a plane for fitting S2 of the die 17*d* with the datum planes S0 of the fitting jig 18, then the punch 16*d* is positioned relative to the die 17*d*.

iii. Screwing the four bolts 17*a*3, the punch 16*d* and the die 17*d* thus positioned with respect to each other are fitted at a predetermined position and the locating and the fitting for the punch and the die are completed.

The fitting jig 18 is the only intervening part between the punch 16*d* and the die 17*d* throughout the above relative positioning and fitting. Therefore it is possible to fit the punch 16*d* into the punch holder 14 as a moving portion of a press working machine with a high accuracy, and it is also possible to fit the die 17*d* into the die supporting bed 15 as a supporting portion of the press working machine. After the fitting of the punch 16*d* and the die 17*d* is completed, the fitting jig 18 must be removed from the punch 16*d* and the die 17*d*. A manufacturing operation for the punching apparatus is completed by fitting the stripper supporting flange 16*k* and the striper 16*n* with the stripper attaching plate 16*h* and fitting the die surrounding spacer 17*g* and the die cover 17*h* with the base plate 17*b*. The punching apparatus in which the punch 16*d* and die 17*d* are thus constructed can punch a hole at a predetermined position on a work piece with high accuracy.

Because the above relative positioning for the punch 16*d* and the die 17*d* is completed by the steps of setting and removing the only one fitting jig; fitting each plane for fitting S1 of the punch 16*d* with each datum plane S0 of the fitting jig 18; and fitting each plane for fitting S2 of the die 17*d* with each datum plane S0 of the fitting jig 15, it is possible to minimize the number of parts used for the fitting operation, reduce the product cost, and also expedite the manufacturing processes by reducing the steps for fitting.

Because the plane for fitting S1 of the punch 16*d* and the plane for fitting S2 of the die 17*d* lie parallel to the direction of the punching operation and cross each other at a right angle, each of the two datum planes S0 of the fitting jig 18 are suitable for anyone of the planes for fitting S1 and S2, and it is possible to simplify the structure of the fitting jig 18 (see the figures) and reduce the production cost.

It is noted that the punch 16*d* and the die 17*d* of the above embodiment are integrally rotatable about the axis L which is parallel to the direction for punching by loosening the four bolts 17*a*3, therefore it is possible to fit the punch 16*d* and the die 17*d* thus positioned with respect to each other by screwing the four bolts 17*a*3.

Besides the mechanism in the above embodiment in which the punch 16*d* and the die 17*d* can continuously rotate about the axis L, another mechanism such as a mechanism for rotating stepwise by a predetermined angle is available for the punching apparatus. It is also possible to tightly fit the punch 16*d* with the punch holder 14 and loosely fit the die 17*d* with the die supporting bed 15 in order to position the die 17*d* and the punch 16*d* with respect to each other by using the fitting jig 18.

Besides the mechanism in the above embodiment in which the plane for fitting S1 of the punch 16*d* and the plane for fitting S2 of the die 17*d* are arranged at tight angles and lie parallel to the direction for punching, fitting planes suitable for attaching to datum faces (not limited to vertical planes) which are formed in the fitting jig 18 or other types of positioning planes can also be used in the present invention.

Besides the punching apparatus in the above embodiment in which the direction of the punching operation is vertical, a punching apparatus in which the operating direction is horizontal or a punching apparatus in which the operating direction inclines to the vertical punching operation can be used in the present invention. Besides the punching apparatus in the above embodiment in which the punch 16*d* is set in the moving portion (the punch holder 14) of the punching apparatus and the die 17*d* is set in the supporting portion (the die holder 15) of the punching apparatus, a punching apparatus in which a punch is set in the supporting portion and the die is set in the moving portion can also be used.

In one embodiment, each of the punch and the die has planes for fitting the datum planes of the fitting jig which are round. Alternately, a fitting jig which is directly fitted with the planes for fitting of the punch and the die so as to position the punch and die with respect to each other is also available. For instance, a rod having a U-shaped profile and rectangular cross section can be used for positioning a punch and a die with respect to each other. The rod comprises a pair of arms, one of which is to be inserted into a rectangular hole which is arranged in the plane for fitting of the punch and directs to the axis L, the other one of which is to be inserted into a rectangular hole which is arranged in the plane for fitting of the die and directs to the axis L. The punch and the die can be fitted and positioned with respect to each other by inserting the arms of the rod into the holes of the punch and the die.

What is claimed is:

1. The punching unit for a punching apparatus for punching a hole at a predetermined location on a work since, comprising a punch;

a die; and a fitting jig for positioning the punch and the die relative to each other, wherein each of the punch and the die has plurality of faces for fitting and the fitting jig has datum planes to be fitted with the planes for fitting of the punch and the die, wherein said punch and the die are rotatable independent of the punching machine, about an axis parallel to the direction for punching and can rotate simultaneously in a state where the datum planes of the fitting jig are attached with each of the planes for fitting of the punch and the die, and wherein said fitting jig has a U-shaped cross section having a pair of arms on one inner surface of which one of the datum planes is arranged and on the other one inner surface of which the other one of the datum planes is arranged in order to hold the punch and the die between said pair of arms and also order to fit the planes for fitting of the punch and the die with the datum planes of the fitting jig while rotating about the axis.

2. A punching apparatus for punching a hole at a predetermined location on a work piece comprising a punch integrated into any one of a moving part of a press working machine and a supporting part of the press working machine; and a die integrated with the other one of the moving part and the supporting part, wherein each of the punch and the die has a plurality of planes to be fitted with datum planes of a fitting jig, wherein the punch and the die are rotatable independent of the moving part and the supporting part about an axis parallel to the direction for punching, and are not possible to rotate relative to each other by touching the planes for fitting with the datum planes of the fitting jig, and wherein said fitting jig has a U-shaped cross section having a pair of arms on one inner surface of which one of the datum planes is arranged and on the other one inner surface of which the other one of the datum planes is arranged in order to hold the punch and the die between said pair of arms and also order to fit the planes for fitting of the punch and the die with the datum planes of the fitting jig while rotating about the axis.

* * * * *